US012044483B2

(12) United States Patent
Sawada et al.

(10) Patent No.: US 12,044,483 B2
(45) Date of Patent: Jul. 23, 2024

(54) PLATE HEAT EXCHANGER AND HEAT TRANSFER APPARATUS

(71) Applicant: Mitsubishi Electric Corporation, Tokyo (JP)

(72) Inventors: Kazunari Sawada, Tokyo (JP); Ryosuke Abe, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 538 days.

(21) Appl. No.: 17/440,391

(22) PCT Filed: Jun. 3, 2019

(86) PCT No.: PCT/JP2019/021987
§ 371 (c)(1),
(2) Date: Sep. 17, 2021

(87) PCT Pub. No.: WO2020/245876
PCT Pub. Date: Dec. 10, 2020

(65) Prior Publication Data

US 2022/0155019 A1 May 19, 2022

(51) Int. Cl.
*F28D 9/00* (2006.01)
*F28F 3/06* (2006.01)
*F28F 3/08* (2006.01)

(52) U.S. Cl.
CPC ..... *F28D 9/0031* (2013.01); *F28F 3/06* (2013.01); *F28F 3/08* (2013.01)

(58) Field of Classification Search
CPC ..... F28D 9/0031; F28D 9/0075; F28D 9/005; F28F 3/06; F28F 3/08; F28F 2275/04;
(Continued)

(56) References Cited

U.S. PATENT DOCUMENTS 4,253,520 A * 3/1981 Friedericy ..... F28F 19/002 165/DIG. 373
5,031,693 A * 7/1991 VanDyke ..... F28F 3/027 165/DIG. 393
(Continued)

FOREIGN PATENT DOCUMENTS

JP 2003-185375 A 7/2003
JP 2008-157544 A 7/2008
(Continued)

OTHER PUBLICATIONS

International Search Report of the International Searching Authority mailed Aug. 20, 2019 in corresponding International Patent Application No. PCT/JP2019/021987 (and English translation).

*Primary Examiner* — Len Tran
*Assistant Examiner* — Gustavo A Hincapie Serna
(74) *Attorney, Agent, or Firm* — Posz Law Group, PLC

(57) ABSTRACT

A plate heat exchanger includes a plurality of first heat transfer plates, a plurality of first inner fins, a plurality of second heat transfer plates, and a plurality of second inner fins. A space is formed between each of the plurality of first heat transfer plates and a corresponding one of the plurality of second heat transfer plates. The plate heat exchanger includes, in the space, a plurality of heat transfer components connecting each of the plurality of first heat transfer plates and a corresponding one of the plurality of second heat transfer plates, the plurality of heat transfer components being interspersed between each of the plurality of first heat transfer plates and a corresponding one of the plurality of second heat transfer plates. A recess-and-projection pitch section in each of the plurality of first inner fins includes first pitch sections and one or more of second pitch sections, a width of each of the second pitch sections being wider than a width of each of the first pitch sections. The plurality of heat transfer components are disposed in regions of the first
(Continued)

pitch sections when the plurality of heat transfer components are projected in a direction in which the plurality of first heat transfer plates and the plurality of second heat transfer plates are stacked.

19 Claims, 7 Drawing Sheets

(58) Field of Classification Search
CPC ..... F28F 3/027; F25B 13/00; F25B 2313/003; F25B 2339/047; F25B 39/04
USPC ..... 165/166
See application file for complete search history.

(56) References Cited

U.S. PATENT DOCUMENTS 6,843,311 B2 * 1/2005 Evans ..... F28D 9/005 165/167
7,059,397 B2 * 6/2006 Chatel ..... F28F 3/027 165/166
10,220,431 B2 * 3/2019 Mitsukawa ..... B21D 13/08
2001/0054499 A1 * 12/2001 Gerard ..... F28F 3/027 165/166
2002/0162646 A1 * 11/2002 Haasch ..... F28F 3/027 165/166
2003/0041640 A1 * 3/2003 Granetzke ..... F28F 3/027 72/186
2004/0031587 A1 * 2/2004 Fong ..... F28F 3/027 257/E23.105
2009/0288812 A1 * 11/2009 Feng ..... B21D 53/04 165/166
2010/0025025 A1 * 2/2010 Tomochika ..... F28D 9/005 165/166
2012/0118548 A1 * 5/2012 Han ..... F28D 9/0043 165/177
2015/0083379 A1 * 3/2015 Ito ..... F28F 9/00 165/166
2015/0260460 A1 * 9/2015 Ito ..... F28D 9/005 165/166
2016/0377350 A1 * 12/2016 Jensen ..... F28D 9/0031 165/166
2017/0051982 A1 * 2/2017 Takami ..... F28D 9/005
2017/0241686 A1 * 8/2017 Szostek ..... F25B 40/02
2018/0126322 A1 * 5/2018 O'Coin ..... A62B 11/00
2018/0299210 A1 * 10/2018 Ronacher ..... F28F 3/027
2019/0310026 A1 * 10/2019 Chopard ..... F28F 3/046
2020/0033065 A1 * 1/2020 Okubo ..... F28D 9/0043
2020/0318529 A1 * 10/2020 Miyagawa ..... F28F 27/02

FOREIGN PATENT DOCUMENTS

WO 2013/183629 A1 12/2013
WO WO-2014125566 A1 * 8/2014 ..... F28D 9/005

* cited by examiner

PLATE HEAT EXCHANGER AND HEAT TRANSFER APPARATUS

CROSS REFERENCE TO RELATED APPLICATION

This application is a U.S. national stage application of PCT/JP2019/021987 filed on Jun. 3, 2019, the contents of which are incorporated herein by reference.

TECHNICAL FIELD

The present disclosure relates to a plate heat exchanger and a heat transfer apparatus. In the plate heat exchanger, each of a plurality of pairs of first heat transfer plates in which a first fluid flows and a corresponding one of a plurality of pairs of second heat transfer plates in which a second fluid flows are stacked.

BACKGROUND ART

Patent Literature 1 describes a plate heat exchanger capable of improving the long-term reliability of an apparatus due to prevention of fluid leakage and of being manufactured at low cost with a simple structure with good heat exchange efficiency achieved. In the technique in Patent Literature 1, each of a plurality of pairs of first heat transfer plates in which a first fluid flows and a corresponding one of a plurality of pairs of second heat transfer plates in which a second fluid flows are stacked. Thus, the first fluid flowing in a pair of the first heat transfer plates and the second fluid flowing in a pair of the second heat transfer plates are unlikely to leak.

CITATION LIST

Patent Literature

Patent Literature 1: International Publication No. 2013/183629

SUMMARY OF INVENTION

Technical Problem

In recent years, there has been a global trend to use low-GWP refrigerant. R32 or R290, which is a low-GWP refrigerant, is a flammable refrigerant. Thus, measures have to be taken to prevent such a refrigerant from leaking indoors. Examples of such measures include formation of a structure for preventing a first fluid or a second fluid from leaking. In the structure, as in the technique in Patent Literature 1, two heat transfer plates, that is, a first heat transfer plate and a second heat transfer plate, are disposed between the first fluid and the second fluid.

However, a fracture form, for example, a part to be fractured, depends on error factors such as manufacturing conditions or environmental conditions. Thus, there is a sufficient possibility that a region where a first heat transfer plate and a second heat transfer plate are in contact with each other is fractured. When a region where a first heat transfer plate and a second heat transfer plate are in contact with each other is fractured, the first fluid and the second fluid are mixed, and flammable refrigerant may flow indoors. Accordingly, it is difficult for all the products to fulfill a function of preventing leakage for a long time.

From the above, it is desirable that, regardless of error factors such as manufacturing conditions or environmental conditions, a region to be fractured be always a region where a first heat transfer plate and a second heat transfer plate are not in contact with each other.

The present disclosure is made to solve the above problem, and an object of the present disclosure is to provide a plate heat exchanger and a heat transfer apparatus. In the plate heat exchanger, regardless of error factors such as manufacturing conditions or environmental conditions, a region to be fractured is always a region where a first heat transfer plate and a second heat transfer plate are not in contact with each other.

Solution to Problem

A plate heat exchanger according to an embodiment of the present disclosure includes: a plurality of first heat transfer plates each having a flat heat transfer surface, a first passage being formed in each pair of the plurality of first heat transfer plates; a plurality of first inner fins each disposed in the corresponding first passage between a pair of the plurality of first heat transfer plates, the plurality of first inner fins being each formed by repeating a recess-and-projection pitch section; a plurality of second heat transfer plates each having a flat heat transfer surface, a second passage being formed in each pair of the plurality of second heat transfer plates between corresponding two pairs of the plurality of first heat transfer plates; and a plurality of second inner fins each disposed in the corresponding second passage between a pair of the plurality of second heat transfer plates, the plurality of second inner fins being each formed by repeating a recess-and-projection pitch section. A space is formed between each of the plurality of first heat transfer plates and a corresponding one of the plurality of second heat transfer plates. The plate heat exchanger includes, in the space, a plurality of heat transfer components connecting each of the plurality of first heat transfer plates and a corresponding one of the plurality of second heat transfer plates, the plurality of heat transfer components being interspersed between each of the plurality of first heat transfer plates and a corresponding one of the plurality of second heat transfer plates. The recess-and-projection pitch section extending in a direction crossing a direction in which a first fluid flows through the first passage in each of the plurality of first inner fins includes first pitch sections and one or more of second pitch sections, a width of each of the second pitch sections being wider than a width of each of the first pitch sections. The plurality of heat transfer components are disposed in regions of the first pitch sections when the plurality of heat transfer components are projected in a direction in which the plurality of first heat transfer plates and the plurality of second heat transfer plates are stacked.

A heat transfer apparatus according to another embodiment of the present disclosure includes the plate heat exchanger.

Advantageous Effects of Invention

In the plate heat exchanger and the heat transfer apparatus according to the embodiments of the present disclosure, the recess-and-projection pitch section extending in the direction crossing the direction in which the first fluid flows through the first passage in each of the plurality of first inner fins includes the first pitch sections and the one or more of the second pitch sections, the width of each of the second pitch sections being wider than the width of each of the first pitch sections. The plurality of heat transfer components are disposed in the regions of the first pitch sections when the plurality of heat transfer components are projected in the direction in which the plurality of first heat transfer plates and the plurality of second heat transfer plates are stacked. Thus, the first heat transfer plate and the second heat transfer plate are connected, via the heat transfer components, at the positions of the first pitch sections that are strong and each have a narrow width. Accordingly, the region of the second pitch section having a wide width where the first heat transfer plate and the second heat transfer plate are not in contact with each other is configured to be always weaker than that of the first pitch section and to be capable of being fractured. Accordingly, regardless of error factors such as manufacturing conditions or environmental conditions, a region to be fractured is always a region where the first heat transfer plate and the second heat transfer plate are not in contact with each other.

DESCRIPTION OF EMBODIMENTS

Figure 1:
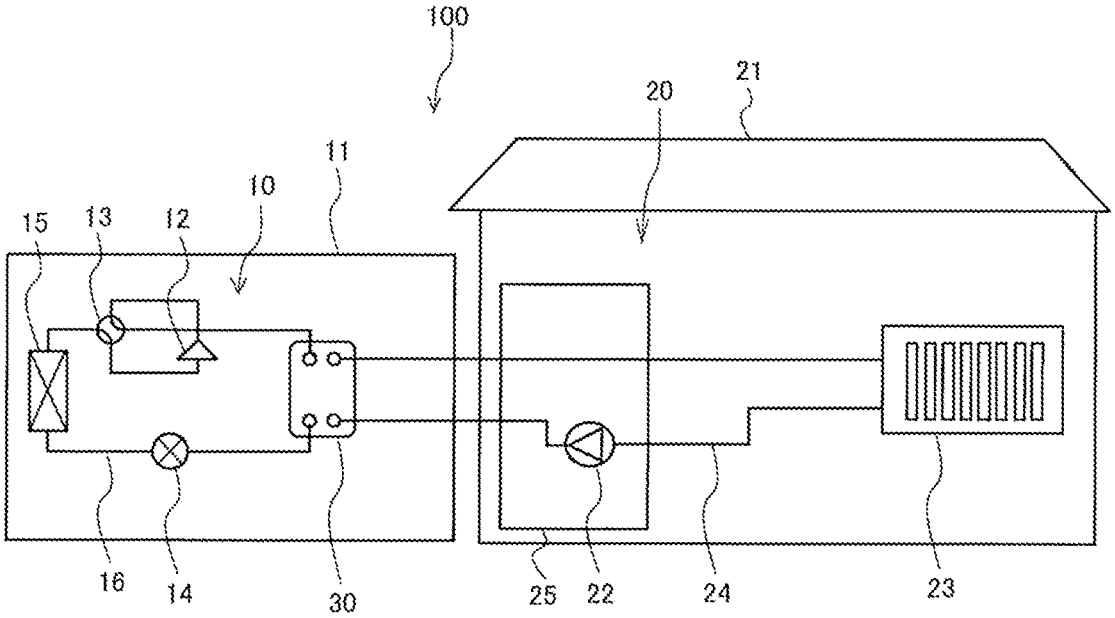
FIG. 1 is a schematic configuration diagram illustrating a heat transfer apparatus according to Embodiment 1.

Embodiments will be described below with reference to the drawings. In the drawings, components having the same reference signs are the same or corresponding components, and this applies to the entire description. In each sectional view, hatching is omitted as appropriate to make it easy to see. In addition, the forms of the components in the entire description are merely examples, and the forms of the components are not limited to those in the description.

Embodiment 1

<Configuration of Heat Transfer Apparatus 100>

FIG. 1 is a schematic configuration diagram illustrating a heat transfer apparatus 100 according to Embodiment 1. As illustrated in FIG. 1, the heat transfer apparatus 100 includes a refrigerant circuit 10, in which a heat medium that is a first fluid is cooled or heated, and a heat medium circuit 20, through which a heat medium flows into a building. The refrigerant circuit 10 is mounted in an outdoor unit 11, which is outdoors. A heat medium circulates from the outdoor unit 11 into a building 21 through the heat medium circuit 20.

<Configuration of Outdoor Unit 11>

The outdoor unit 11 includes a compressor 12, a four-way valve 13, a plate heat exchanger 30, an expansion valve 14, and an outdoor heat exchanger 15. In the outdoor unit 11, the refrigerant circuit 10 is formed by connecting the compressor 12, the four-way valve 13, the plate heat exchanger 30, the expansion valve 14, and the outdoor heat exchanger 15 in this order via refrigerant pipes 16 to have an annular shape. The outdoor unit 11 is a heat pump device. Refrigerant that is a second fluid flows in the refrigerant circuit 10.

The compressor 12 compresses refrigerant into high-temperature, high-pressure refrigerant. Various types of compressors such as a scroll compressor or a rotary compressor are usable as the compressor 12.

The four-way valve 13 switches respective flow directions in the refrigerant circuit 10 in a cooling operation and a heating operation.

The plate heat exchanger 30 functions as an evaporator or a condenser. The plate heat exchanger 30 has heat medium passages 38 serving as first passages through which a heat medium flows and refrigerant passages 39 serving as second passages through which refrigerant flows. The plate heat exchanger 30 exchanges heat between a heat medium flowing through the heat medium passages 38 and refrigerant flowing through the refrigerant passages 39. In the cooling operation, the plate heat exchanger 30 exchanges heat between a heat medium and refrigerant that has been cooled by passing through the expansion valve 14. As a result, the heat medium is cooled in the plate heat exchanger 30. In the heating operation, the plate heat exchanger 30 exchanges heat between a heat medium and high-temperature, high-pressure refrigerant that has been compressed by the compressor 12. As a result, the heat medium is heated in the plate heat exchanger 30.

The expansion valve 14 functions as an expansion mechanism between the plate heat exchanger 30 and the outdoor heat exchanger 15.

The outdoor heat exchanger 15 functions as a condenser when the plate heat exchanger 30 functions as an evaporator. The outdoor heat exchanger 15 functions as an evaporator when the plate heat exchanger 30 functions as a condenser. The outdoor heat exchanger 15 is an air heat exchanger configured to exchange heat between refrigerant and air that is the outside air.

For example, flammable refrigerant such as R32 or R290, which is a low-GWP refrigerant, is usable as refrigerant that is the second fluid in the outdoor unit 11.

<Configuration of Heat Medium Circuit 20>

The heat medium circuit 20 includes the plate heat exchanger 30, a circulating pump 22, and a radiator 23. The heat medium circuit 20 is formed by connecting the plate heat exchanger 30, the circulating pump 22, and the radiator 23 via heat medium pipes 24 to have an annular shape. The heat medium circuit 20 may include a storage tank (not illustrated) that stores a heat medium. A heat medium that is the first fluid is water or brine.

The circulating pump 22 applies a discharge force with which a heat medium flows through the heat medium pipes 24 in a certain direction. The circulating pump 22 is mounted in an indoor unit 25 in the building 21. The circulating pump 22 may be mounted in the outdoor unit 11.

The radiator 23 cools or heats the interior of the building 21 with cooling energy or heat of a heat medium. For example, an air-conditioning apparatus other than the radiator 23 may be disposed in the heat medium circuit 20. In addition, the heat medium circuit 20 may be used as a hot-water supply apparatus configured to supply hot water by using water as a heat medium.

<Other>

The heat transfer apparatus 100 is usable for many industrial or household apparatuses in which the plate heat exchanger 30 is mounted. The heat transfer apparatus 100 is applicable to, for example, an air-conditioning apparatus, an electric generator, or a heat sterilizer for food.

<Configuration of Plate Heat Exchanger 30>

Figure 2:
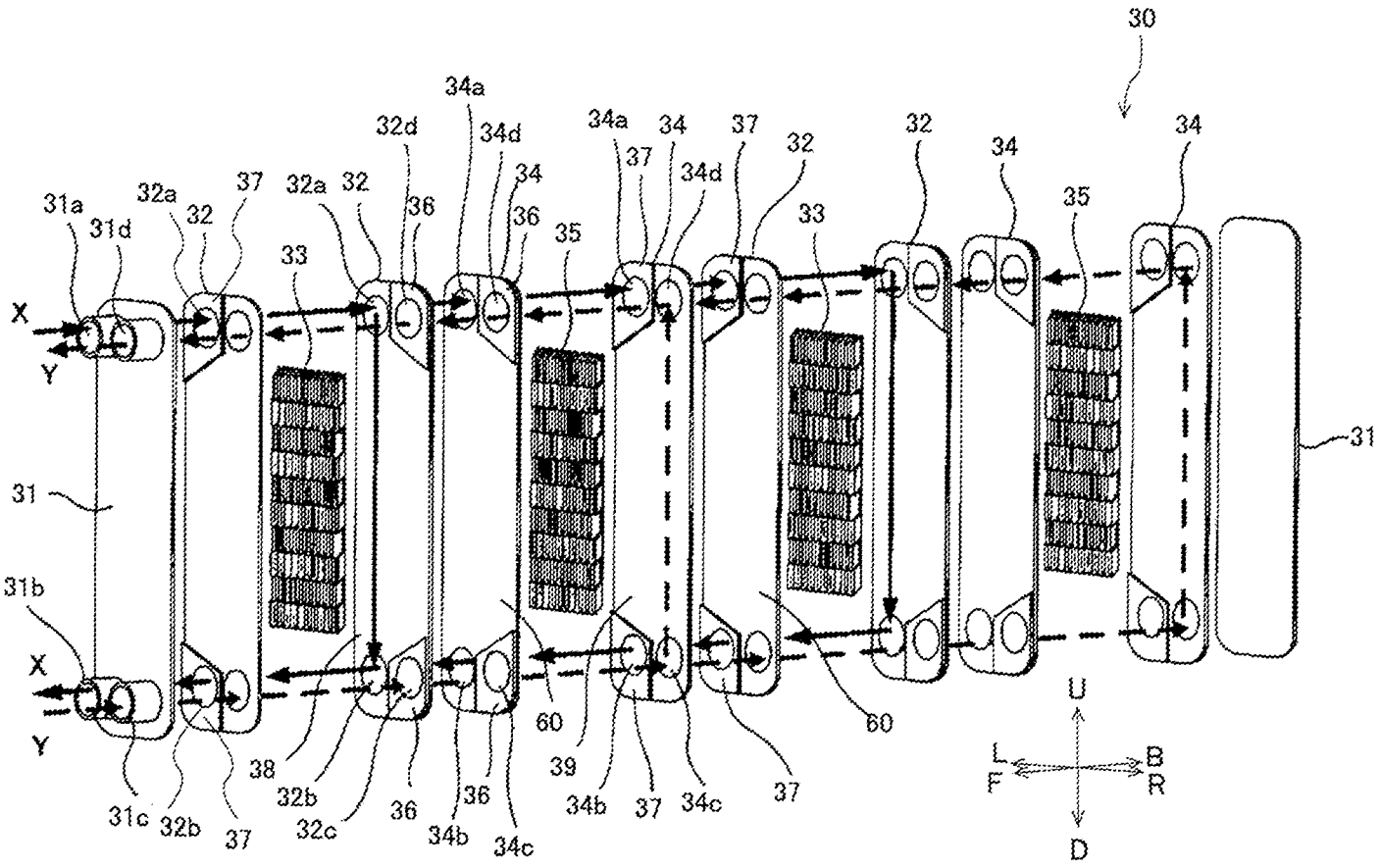
FIG. 2 is an exploded perspective view illustrating a plate heat exchanger according to Embodiment 1.

FIG. 2 is an exploded perspective view illustrating the plate heat exchanger 30 according to Embodiment 1. FIG. 2 illustrates an upward direction U, a downward direction D, a rightward direction R, a leftward direction L, a forward direction F, and a backward direction B. As illustrated in FIG. 2, the plate heat exchanger 30 includes a pair of side plates 31, a plurality of first heat transfer plates 32, a plurality of first inner fins 33, a plurality of second heat transfer plates 34, and a plurality of second inner fins 35. A synthetic resin or a metal such as stainless steel, copper, aluminum, or titanium is usable as materials for various components of the plate heat exchanger 30. The first heat transfer plates 32 or the second heat transfer plates 34 may be made of a clad material.

The pair of side plates 31 each have a flat shape and are disposed, to function as reinforcements, on respective sides of the structure formed by stacking the first heat transfer plates 32, the first inner fins 33, the second heat transfer plates 34, and the second inner fins 35 in a predetermined order.

Four passage holes, that is, a heat medium inlet 31*a*, a heat medium outlet 31*b*, a refrigerant inlet 31*c*, and a refrigerant outlet 31*d*, are disposed at the respective four corners of one of the pair of side plates 31. FIG. 2 illustrates the heat medium inlet 31*a* at the upper corner closer to one end in the left-right direction in the figure, the heat medium outlet 31*b* at the lower corner closer to the one end in the left-right direction, the refrigerant inlet 31*c* at the lower corner closer to the other end in the left-right direction, and the refrigerant outlet 31*d* at the upper corner closer to the other end in the left-right direction. In FIG. 2, the direction in which a heat medium flows is represented by a sign X, which is a solid arrow, and the direction in which refrigerant flows is represented by a sign Y, which is a dashed arrow.

The first heat transfer plates 32 each have a flat heat transfer surface. The heat medium passage 38 serving as the first passage through which a heat medium flows is formed in each pair of the first heat transfer plates 32. A heat medium flows, through the heat medium passage 38, downward in the height direction extending in the upward direction U and the downward direction D. A heat medium may flow through the heat medium passage 38 such that, for example, the heat medium passage 38 is inclined relative to the height direction to extend from the upper position on the leftward direction L where the heat medium inlet 31*a* is located to the lower position on the rightward direction R where the refrigerant inlet 31*c* is located.

The first inner fins 33 are each disposed in the corresponding heat medium passage 38 between a pair of the first heat transfer plates 32 and are each formed by repeating a recess-and-projection pitch section 40.

The second heat transfer plates 34 each have a flat heat transfer surface. The refrigerant passage 39 serving as the second passage through which refrigerant flows is formed in each pair of the second heat transfer plates 34 between the corresponding two pairs of the first heat transfer plates 32. Refrigerant flows, through the refrigerant passage 39, upward in the height direction extending in the upward direction U and the downward direction D. Refrigerant may flow through the refrigerant passage 39 such that, for example, the refrigerant passage 39 is inclined relative to the height direction to extend from the lower position on the leftward direction L where the heat medium outlet 31*b* is located to the upper position on the rightward direction R where the refrigerant outlet 31*d* is located.

The second inner fins 35 are each disposed in the corresponding refrigerant passage 39 between a pair of the second heat transfer plates 34 and are each formed by repeating a recess-and-projection pitch section 50.

The first heat transfer plates 32 and the second heat transfer plates 34 are formed, to have recesses and projections, by, for example, pressing plate-like components having a substantially uniform thickness.

The first heat transfer plates 32 and the second heat transfer plates 34 may have a different thickness as appropriate. Increasing the thickness is effective for preventing corrosion of the plate heat exchanger 30 from progressing and for increasing the strength of the plate heat exchanger 30. On the other hand, reducing the thickness enables the thermal resistance and the material costs to be reduced and enables a reduction in the heat exchange performance to be inhibited. In such a manner, it is preferable to determine the thickness of each of the first heat transfer plates 32 and the second heat transfer plates 34 according to desired conditions.

Through holes serving as passage holes are formed at the respective four corners of the first heat transfer plates 32 and the second heat transfer plates 34. Specifically, a heat medium outward hole 32*a*, a heat medium return hole 32*b*, a refrigerant outward hole 32*c*, and a refrigerant return hole 32*d*, which serve as passage holes, are disposed in the first heat transfer plate 32. Similarly, a heat medium outward hole 34*a*, a heat medium return hole 34*b*, a refrigerant outward hole 34*c*, and a refrigerant return hole 34*d*, which serve as passage holes, are disposed in the second heat transfer plate 34.

The first heat transfer plates 32 and the second heat transfer plates 34 each have a flat heat transfer surface that forms the corresponding heat medium passage 38 or refrigerant passage 39. Projecting portions 36 and 37, which have a relative relationship with each other, are formed on the first heat transfer plates 32 and the second heat transfer plates 34. All the projecting portions 36 and 37 project in the forward direction F.

In the case of a pair of the first heat transfer plates 32 forming the heat medium passage 38, through which a heat medium flows and which is represented by the sign X, the projecting portions 36 are disposed to occupy respective parts around the refrigerant outward hole 32*c* and the refrigerant return hole 32*d*, and the projecting portions 37 are disposed to occupy respective parts around the heat medium outward hole 32*a* and the heat medium return hole 32*b*.

In the case of a pair of the second heat transfer plates 34 forming the refrigerant passage 39, through which refrigerant flows and which is represented by the sign Y, the projecting portions 36 are disposed to occupy respective parts around the refrigerant outward hole 34*c* and the refrigerant return hole 34*d*, and the projecting portions 37 are disposed to occupy respective parts around the heat medium outward hole 34*a* and the heat medium return hole 34*b*.

Each of the first inner fins 33 is an offset fin for promoting heat transfer disposed between the corresponding pair of the first heat transfer plates 32. The first inner fins 33 each have a substantially plate-like shape whose each part in the width direction and the height direction is larger than a part thereof in the thickness direction. The first inner fins 33 each have a structure formed by repeating the recess-and-projection pitch section 40, in which a thin component extends in the rightward direction R and the leftward direction L, that is, in the width direction, to form substantially right angles (see FIGS. 3, 4, and 5). A top portion or a bottom portion that faces each of a pair of the first heat transfer plates 32 in the recess-and-projection pitch section 40 is formed into a flat surface. Thus, each of the first inner fins 33 is in surface contact with the corresponding pair of the first heat transfer plates 32 at the flat surfaces of the top portions or the bottom portions.

Each of the second inner fins 35 is an offset fin for promoting heat transfer disposed between the corresponding pair of the second heat transfer plates 34. The second inner fins 35 each have a substantially plate-like shape whose each part in the width direction and the height direction is larger than a part thereof in the thickness direction. The second inner fins 35 each have a structure formed by repeating the recess-and-projection pitch section 50, in which a thin component extends in the rightward direction R and the leftward direction L, that is, in the width direction, to form substantially right angles (see FIGS. 3 and 4). A top portion or a bottom portion that faces each of a pair of the second heat transfer plates 34 in the recess-and-projection pitch section 50 is formed into a flat surface. Thus, each of the second inner fins 35 is in surface contact with the corresponding pair of the second heat transfer plates 34 at the flat surfaces of the top portions or the bottom portions.

The first inner fin 33 and the second inner fin 35 have different heat transfer areas. Specifically, in the first inner fin 33 and the second inner fin 35, the recess-and-projection pitch section 40 and the recess-and-projection pitch section 50 differ from each other in size (see FIGS. 3 and 4), which will be described in detail below. FIG. 2 illustrates the first inner fin 33 and the second inner fin 35 similarly to clarify the figure.

A pair of the first heat transfer plates 32 between which the first inner fin 33 is interposed are soldered to the first inner fin 33. A pair of the second heat transfer plates 34 between which the second inner fin 35 is interposed are soldered to the second inner fin 35. The first heat transfer plate 32 and the second heat transfer plate 34 facing the first heat transfer plate 32 are soldered to each other, with soldering portions 61, which serve as heat transfer components, at a plurality of parts between which a space 60 is interposed (see FIG. 3). Thus, the first heat transfer plate 32 and the second heat transfer plate 34 form a double-wall structure in which the space 60 is interposed between the soldering portions 61 serving as heat transfer components and have improved heat transfer efficiency.

On one side plate 31, the first heat transfer plate 32, the first inner fin 33, the first heat transfer plate 32, the second heat transfer plate 34, the second inner fin 35, and the second heat transfer plate 34, which are stacking components, are stacked and disposed in this order repeatedly as needed, and the other side plate 31 is finally stacked thereon to form a stacked structure.

<Details of Plate Heat Exchanger 30>

Figure 3:
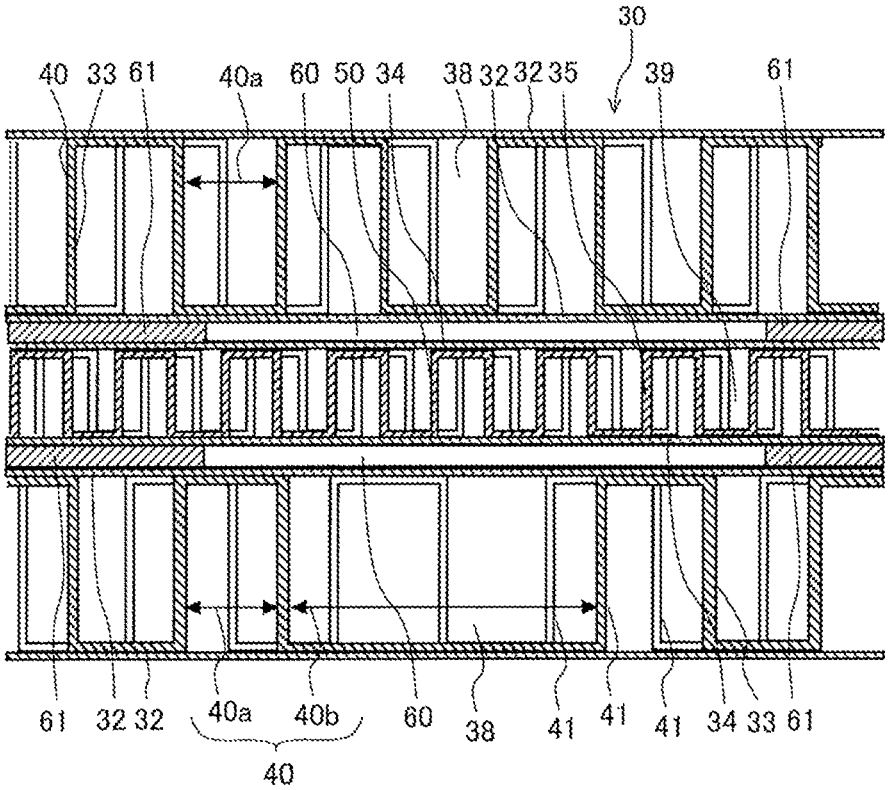
FIG. 3 is a diagram illustrating the plate heat exchanger according to Embodiment 1 in cross section.
Figure 4:
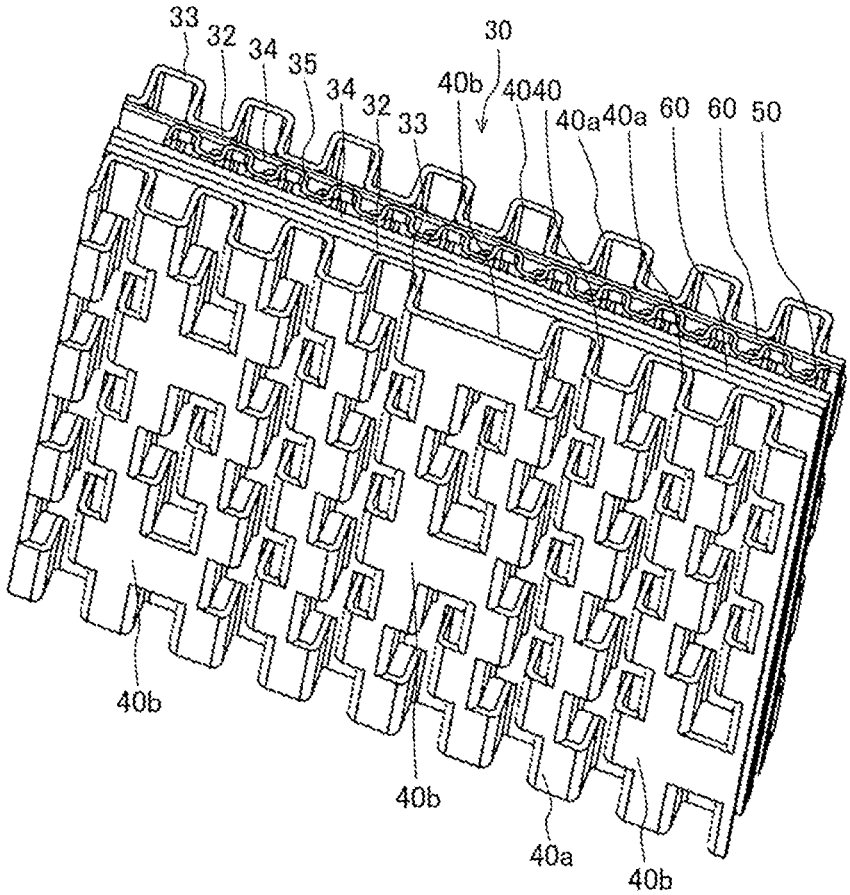
FIG. 4 is a partial perspective view illustrating the configuration between two first inner fins according to Embodiment 1.
Figure 5:
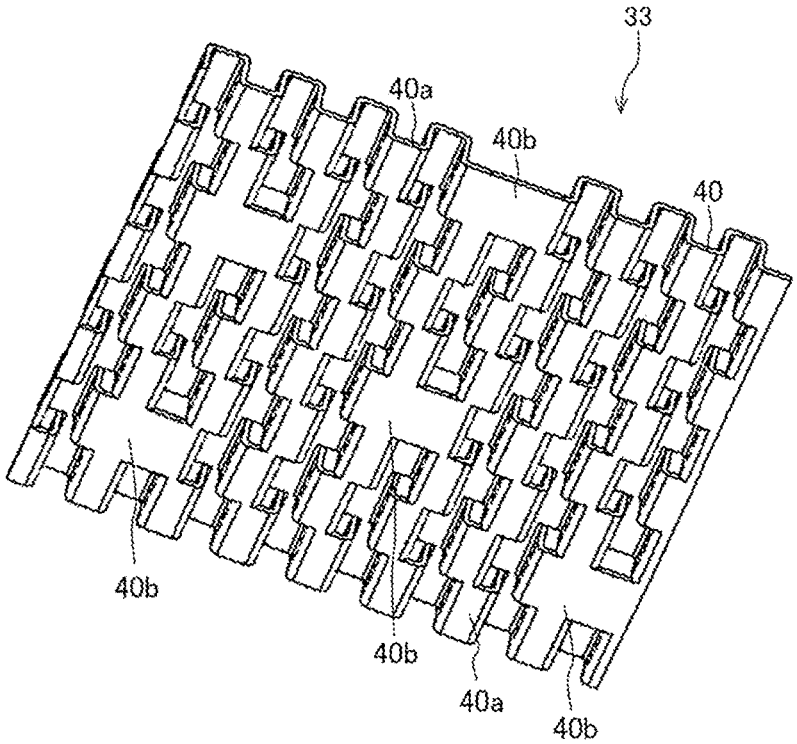
FIG. 5 is a perspective view illustrating a first inner fin according to Embodiment 1.

FIG. 3 is a diagram illustrating the plate heat exchanger 30 according to Embodiment 1 in cross section. FIG. 4 is a partial perspective view illustrating the configuration between two first inner fins 33 according to Embodiment 1. FIG. 5 is a perspective view illustrating the first inner fin 33 according to Embodiment 1.

As illustrated in FIGS. 3, 4, and 5, the first inner fin 33 includes the recess-and-projection pitch section 40. Specifically, the first inner fin 33 includes a plurality of recess-and-projection pitch sections 40, each of which extends in a direction crossing the height direction extending in the upward direction U and the downward direction D, which is the direction in which a heat medium flows through the heat medium passage 38 in each of the first inner fins 33, such that the recess-and-projection pitch sections 40 are arranged in the direction in which a heat medium flows through the heat medium passage 38 in each of the first inner fins 33. Here, the recess-and-projection pitch sections 40 are each disposed in the width direction extending in the rightward direction R and the leftward direction L, which is a direction orthogonal to the direction in which a heat medium flows through the heat medium passage 38 in each of the first inner fins 33.

Here, the recess-and-projection pitch section 40 has passage holes in the direction in which a heat medium flows through the heat medium passage 38 in each of the first inner fins 33, and the recess-and-projection pitch section 40 has a shape in which a recess and a projection are repeated in the direction crossing the direction in which a heat medium flows through the heat medium passage 38 in each of the first inner fins 33. The plate surfaces in the recess-and-projection pitch section 40 extend in the direction in which a heat medium flows through the heat medium passage 38 in each of the first inner fins 33, and the recess-and-projection pitch section 40 does not block a heat medium from flowing through the heat medium passage 38.

Some of the recess-and-projection pitch sections 40 extending in the direction crossing the direction in which a heat medium flows through the heat medium passage 38 in each of the first inner fins 33 include first pitch sections 40*a* and second pitch sections 40*b*, whose width is wider than that of the first pitch section 40*a*. Some of the recess-and-projection pitch sections 40 extending in the direction crossing the direction in which a heat medium flows through the heat medium passage 38 in each of the first inner fins 33 include only the first pitch sections 40*a*.

The recess-and-projection pitch sections 40 of the first inner fin 33 each extend, to be bent at right angles, orthogonally or parallel to the direction crossing the direction in which a heat medium flows through the heat medium passage 38 in each of the first inner fins 33.

An orthogonal portion 41 of the recess-and-projection pitch section 40 of the first inner fin 33, which extends to connect a pair of the first heat transfer plates 32 in the pair of the first heat transfer plates 32, is disposed between and shifted from the orthogonal portions 41 adjacent to each other of the adjacent recess-and-projection pitch section 40 in the direction in which a heat medium flows through the heat medium passage 38 in each of the first inner fins 33 (see FIG. 3).

In particular, preferably, the orthogonal portion 41 of the recess-and-projection pitch section 40 of the first inner fin 33, which extends to connect a pair of the first heat transfer plates 32 in the pair of the first heat transfer plates 32, is disposed at the center between and shifted from the orthogonal portions 41 adjacent to each other of the adjacent recess-and-projection pitch section 40 in the direction in which a heat medium flows through the heat medium passage 38 in each of the first inner fins 33.

One or more second pitch sections 40*b* are disposed in each of the recess-and-projection pitch sections 40 with at least one of the first pitch sections 40*a* interposed therebetween in the direction crossing the direction in which a heat medium flows through the heat medium passage 38 in each of the first inner fins 33. Specifically, as illustrated in FIGS.

4 and 5, in the lowermost part, two second pitch sections 40*b* are disposed in the recess-and-projection pitch section 40 with nine first pitch sections 40*a* interposed therebetween in the direction crossing the direction in which a heat medium flows through the heat medium passage 38 in each of the first inner fins 33. In parts other than the lowermost part, one second pitch section 40*b* is disposed in the recess-and-projection pitch section 40 in the direction crossing the direction in which a heat medium flows through the heat medium passage 38 in each of the first inner fins 33.

As illustrated in FIGS. 4 and 5, the second pitch section 40*b* is disposed to be shifted, in the direction crossing the direction in which a heat medium flows through the heat medium passage 38, from the second pitch section 40*b* of the recess-and-projection pitch section 40 different in position in the direction in which a heat medium flows through the heat medium passage 38 in each of the first inner fins 33.

The recess-and-projection pitch section 40 including only the first pitch sections 40*a* is disposed between the recess-and-projection pitch section 40 including the second pitch section 40*b* at a position in the direction in which a heat medium flows through the heat medium passage 38 in each of the first inner fins 33 and the recess-and-projection pitch section 40 including the second pitch section 40*b* different in position in the direction in which a heat medium flows through the heat medium passage 38 in each of the first inner fins 33.

As illustrated in FIGS. 3 and 4, the recess-and-projection pitch section 40 including the second pitch section 40*b* at a position in the direction in which a heat medium flows through the heat medium passage 38 in each of the first inner fins 33 faces the recess-and-projection pitch section 40 including only the first pitch sections 40*a* of the first inner fin 33 between a pair of the first heat transfer plates 32 next to the adjacent pair of the second heat transfer plates 34 in the direction in which the first heat transfer plates 32 and the second heat transfer plates 34 are stacked.

As illustrated in FIGS. 4 and 5, identical sides of the second pitch sections 40*b* disposed in the first inner fin 33 are open in the direction in which the first heat transfer plates 32 and the second heat transfer plates 34 are stacked.

As illustrated in FIGS. 3, 4, and 5, the value calculated by dividing the width of the first pitch section 40*a* by the width of the second pitch section 40*b* is less than 1. Preferably, the value calculated by dividing the width of the first pitch section 40*a* by the width of the second pitch section 40*b* is less than 1 and more than 0.5.

<Details of Soldering Portions 61>

As illustrated in FIG. 3, the space 60 is formed between the first heat transfer plate 32 and the second heat transfer plate 34. The soldering portions 61 serving as heat transfer components connecting the first heat transfer plate 32 and the second heat transfer plate 34 between which the heat transfer components are interspersed are disposed in the space 60.

Any soldering material may be used as a soldering material for the soldering portions 61 as long as the material has heat transfer properties higher than those of air, and examples of such a material include metal solder such as copper solder, silver solder, or phosphorus deoxidized copper. Instead of the soldering portions 61, for example, metal heat transfer components may be disposed by adhesion or other methods. In addition, a highly adhesive liquid or solid material such as grease may be used as a heat transfer component. Furthermore, regarding heat transfer components, the first heat transfer plate 32 and the second heat transfer plate 34 may be directly joined to each other, without an additional component interposed therebetween, by, for example, spot welding or pressure bonding. However, when the first heat transfer plate 32 and the second heat transfer plate 34 are directly joined to each other, the space 60 has to be disposed therebetween.

The soldering portions 61 serving as heat transfer components are disposed in the regions of the first pitch sections 40*a* when the soldering portions 61 are projected in the direction in which the first heat transfer plates 32 and the second heat transfer plates 34 are stacked. In other words, the soldering portions 61 serving as heat transfer components do not exist in the regions of the second pitch sections 40*b* when the soldering portions 61 are projected in the direction in which the first heat transfer plates 32 and the second heat transfer plates 34 are stacked.

<Operation of Soldering Portions 61 Between First Heat Transfer Plate 32 and Second Heat Transfer Plate 34>

The soldering portions 61, with which the first heat transfer plate 32 and the second heat transfer plate 34 are soldered to each other, have high thermal conductivity and enable the thermal contact resistance between the first heat transfer plate 32 and the second heat transfer plate 34 to be reduced and a reduction in heat exchange performance to be further inhibited.

On the other hand, the space 60, in which the first heat transfer plate 32 and the second heat transfer plate 34 are not soldered to each other, is open to the air. Thus, when the first heat transfer plate 32 is fractured, a heat medium is released into the air. Here, when the position of the second pitch section 40*b* is projected in the direction in which the first heat transfer plates 32 and the second heat transfer plates 34 are stacked, the space 60 is always formed, at the position of the second pitch section 40*b*, between the second heat transfer plate 34 and the first heat transfer plate 32 adjacent to another first heat transfer plate 32. The width of the second pitch section 40*b* of the first inner fin 33 is larger than the width of the first pitch section 40*a*. Thus, for example, when the heat medium is water and higher pressure than normal is generated in the heat medium passage 38 due to freezing, internal pressure increase, or other reasons, the stress generated at the position of the second pitch section 40*b* is higher than the stress generated at the surrounding part. Accordingly, it is possible to set a part of the first heat transfer plate 32 to be fractured always at the position of the second pitch section 40*b*. The second pitch sections 40*b* are disposed to cover regions in which pressure increase is generated. Thus, it is possible to expect a part of the first heat transfer plate 32 to be fractured and to discharge a leaked heat medium to the outside. Accordingly, it is possible to prevent leaked refrigerant from flowing into the building 21 through the heat medium circuit 20 due to fracturing in the part where the first heat transfer plate 32 and the second heat transfer plate 34 are joined.

<Details of Recess-and-Projection Pitch Section 50 of Second Inner Fin 35>

As illustrated in FIGS. 3 and 4, the recess-and-projection pitch section 50 of the second inner fin 35 is formed by repeating a recess and a projection at a certain pitch. A distinctive second pitch section 40*b* as in the recess-and-projection pitch section 40 of the first inner fin 33 is not disposed in the recess-and-projection pitch section 50 of the second inner fin 35.

The recess-and-projection pitch section 50 of the second inner fin 35 includes a recess and a projection smaller than those of the recess-and-projection pitch section 40 of the first inner fin 33. Here, the flat heat transfer surfaces of the first heat transfer plates 32 matched with the first inner fin 33 are joined to each other, and the flat heat transfer surfaces of the second heat transfer plates 34 matched with the second inner fin 35 are joined to each other. Thus, when the heat medium is a high-pressure fluid and the refrigerant is a low-pressure fluid, the first inner fin 33, in which recesses and projections are large and whose contact area with the first heat transfer plates 32 is large, is used for the heat medium passage 38, through which the heat medium flows, and the second inner fin 35, in which recesses and projections are small and whose contact area with the second heat transfer plates 34 is small, is used for the refrigerant passage 39, through which the refrigerant flows. This enables each part to have a necessary and sufficient strength and maintenance of such a strength to be efficiently achieved as a whole.

As described above, a small-pitch fin that provides good heat transfer performance is used at the refrigerant side significantly affected by pressure loss. A large-pitch fin that provides poor heat transfer performance and in which pressure loss is small is used at the heat medium side. As a result, it is possible to equalize the thermal resistivity of refrigerant and water. In such a manner, it is possible to adjust, according to flowing fluid properties, the thermal resistivity of a heat medium that is the first fluid and refrigerant that is the second fluid, resulting in an increase in heat exchange efficiency.

<Other>

Figure 6:
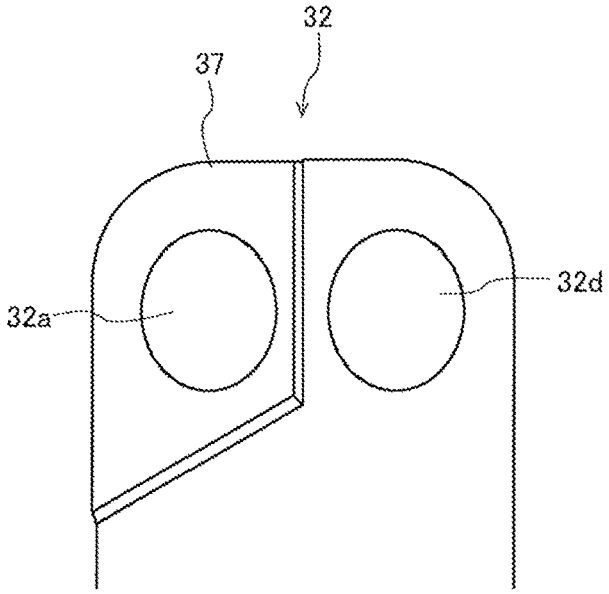
FIG. 6 is an enlarged view illustrating a part of a first heat transfer plate according to Embodiment 1.

FIG. 6 is an enlarged view illustrating a part of the first heat transfer plate 32 according to Embodiment 1. As illustrated in FIG. 6, the first heat transfer plate 32 and the second heat transfer plate 34 each have a shape that covers the whole region including the region where the passage holes exist.

<Modification 1>

Figure 7:
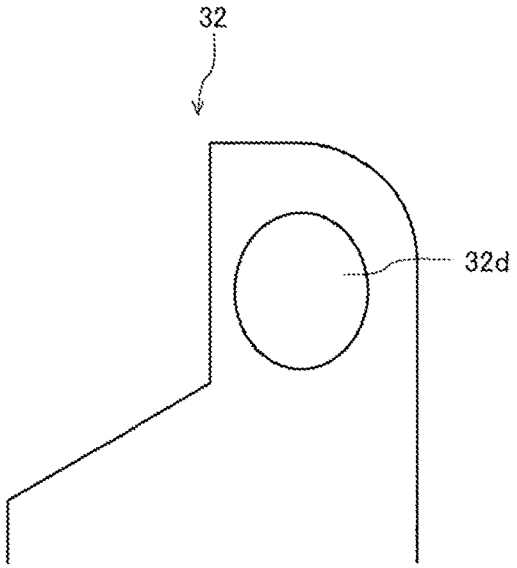
FIG. 7 is an enlarged view illustrating a part of a first heat transfer plate according to Modification 1 of Embodiment 1.

FIG. 7 is an enlarged view illustrating a part of a first heat transfer plate 32 according to Modification 1 of Embodiment 1. As illustrated in FIG. 7, the first heat transfer plate 32 or the second heat transfer plate 34 may have a shape that does not include the region where a passage hole exists and that covers only the region where a heat medium and refrigerant are adjacent to each other. For example, the first heat transfer plate 32 or the second heat transfer plate 34 may have a shape in which the projecting portion 37 that is a part around the heat medium outward hole 32*a* in the first heat transfer plate 32 is cut off. This enables the amount of the material for the first heat transfer plate 32 and the second heat transfer plate 34 used to be reduced and enables the plate heat exchanger 30 to be manufactured at low cost.

<Operation>

As described above, the plate heat exchanger 30 is capable of improving the long-term reliability of the heat transfer apparatus 100 by preventing refrigerant from entering the building 21 through the heat medium circuit 20 and of being manufactured at low cost with a simple structure while the thermal resistivity of a heat medium and refrigerant between which heat is exchanged is maintained at an equal level and good heat exchange efficiency is maintained. Thus, it is possible to use, for example, natural refrigerant such as $CO_2$, flammable hydrocarbon, or low-GWP refrigerant, which has not been usable because there has been no function of preventing refrigerant from entering. In addition, a fluid to be used is selected among an increased range of fluids, and it is thus possible to select a refrigerant having high latent heat and to improve heat exchange performance.

Effects of Embodiment 1

According to Embodiment 1, the plate heat exchanger 30 includes the first heat transfer plates 32 each having a flat heat transfer surface, the heat medium passage 38 serving as the first passage being formed in each pair of the first heat transfer plates 32. The plate heat exchanger 30 includes the first inner fins 33 each disposed in the corresponding heat medium passage 38 between a pair of the first heat transfer plates 32 and each formed by repeating the recess-and-projection pitch section 40. The plate heat exchanger 30 includes the second heat transfer plates 34 each having a flat heat transfer surface, the refrigerant passage 39 serving as the second passage being formed in each pair of the second heat transfer plates 34 between the corresponding two pairs of the first heat transfer plates 32. The plate heat exchanger 30 includes the second inner fins 35 each disposed in the corresponding refrigerant passage 39 between a pair of the second heat transfer plates 34 and each formed by repeating the recess-and-projection pitch section 50. The space 60 is formed between each of the first heat transfer plates 32 and a corresponding one of the second heat transfer plates 34. The plate heat exchanger 30 includes, in the space 60, the soldering portions 61 serving as the heat transfer components connecting each of the first heat transfer plates 32 and a corresponding one of the second heat transfer plates 34, the heat transfer components being interspersed between each of the first heat transfer plates 32 and a corresponding one of the second heat transfer plates 34. The recess-and-projection pitch section 40 extending in the direction crossing the direction in which a heat medium serving as the first fluid flows through the heat medium passage 38 in each of the first inner fins 33 includes the first pitch sections 40*a* and one or more of the second pitch sections 40*b*, the width of each of the second pitch sections 40*b* being wider than the width of each of the first pitch sections 40*a*. The soldering portions 61 are disposed in the regions of the first pitch sections 40*a* when the soldering portions 61 are projected in the direction in which the first heat transfer plates 32 and the second heat transfer plates 34 are stacked.

With this configuration, the first heat transfer plate 32 and the second heat transfer plate 34 are connected at the positions of the first pitch sections 40*a*, which are strong and each have a narrow width, via the soldering portions 61 in the direction in which the first heat transfer plates 32 and the second heat transfer plates 34 are stacked. Thus, the space 60 is adjacent to the first heat transfer plate 32 at the position of the second pitch section 40*b* having a wide width where the first heat transfer plate 32 and the second heat transfer plate 34 are not in contact with each other in the direction in which the first heat transfer plates 32 and the second heat transfer plates 34 are stacked, and the region of the second pitch section 40*b* is configured to be always weaker than that of the first pitch section 40*a* and to be capable of being fractured. Accordingly, regardless of error factors such as manufacturing conditions or environmental conditions, a region to be fractured is always a region where the first heat transfer plate 32 and the second heat transfer plate 34 are not in contact with each other. As a result, the plate heat exchanger 30 is capable of improving safety by completely preventing, for example, flammable refrigerant from flowing into the building 21 through the heat medium circuit 20 without a heat medium and the refrigerant mixed and of being manufactured at low cost with a simple structure with good heat exchange efficiency achieved.

According to Embodiment 1, the soldering portions 61 do not exist in the regions of the one or more of the second pitch sections 40*b* when the soldering portions 61 are projected in the direction in which the first heat transfer plates 32 and the second heat transfer plates 34 are stacked.

With this configuration, the width of the second pitch section 40*b* is wider than the width of the first pitch section 40*a*, and the space 60, in which the soldering portions 61 are not interposed between the first heat transfer plate 32 and the second heat transfer plate 34, can be formed adjacent to the first heat transfer plate 32. Thus, the region of the second pitch section 40*b* can be configured to be always weaker than that of the first pitch section 40*a* and to be capable of being fractured.

According to Embodiment 1, the one or more of the second pitch sections 40*b* are disposed in the recess-and-projection pitch section 40 with at least one of the first pitch sections 40*a* interposed between the one or more of the second pitch sections 40*b* in the direction crossing the direction in which a heat medium flows through the heat medium passage 38 in each of the first inner fins 33.

With this configuration, the regions of the second pitch sections 40*b*, which are always weaker than those of the first pitch sections 40*a* and which are capable of being fractured, are disposed in each of the first inner fins 33 of the plate heat exchanger 30 such that the second pitch sections 40*b* cover regions in which pressure increase is generated.

According to Embodiment 1, the one or more of the second pitch sections 40*b* are disposed to be shifted, in the direction crossing the direction in which a heat medium flows through the heat medium passage 38, from the second pitch section 40*b* of the recess-and-projection pitch section 40 different in position in the direction in which a heat medium flows through the heat medium passage 38 in each of the first inner fins 33.

With this configuration, the second pitch sections 40*b* that are continuously adjacent to each other in the direction in which a heat medium flows through the heat medium passage 38 in each of the first inner fins 33 are not formed. This enables the regions of the second pitch sections 40*b* not to be excessively weak.

According to Embodiment 1, the recess-and-projection pitch section 40 including only the first pitch sections 40*a* is disposed between the recess-and-projection pitch section 40 including the one or more of the second pitch sections 40*b* at a position in the direction in which a heat medium flows through the heat medium passage 38 in each of the first inner fins 33 and the recess-and-projection pitch section 40 including the one or more of the second pitch sections 40*b* different in position in the direction in which a heat medium flows through the heat medium passage 38 in each of the first inner fins 33.

With this configuration, the second pitch sections 40*b* that are continuously adjacent to each other in the direction in which a heat medium flows through the heat medium passage 38 in each of the first inner fins 33 are not formed. This enables the regions of the second pitch sections 40*b* not to be excessively weak.

According to Embodiment 1, the recess-and-projection pitch section 40 including the one or more of the second pitch sections 40*b* at a position in the direction in which a heat medium flows through the heat medium passage 38 in each of the first inner fins 33 faces the recess-and-projection pitch section 40 including only the first pitch sections 40*a* of one of the first inner fins 33 between a pair of the first heat transfer plates 32 next to the adjacent pair of the second heat transfer plates 34 in the direction in which the first heat transfer plates 32 and the second heat transfer plates 34 are stacked.

With this configuration, the adjacent second pitch sections 40*b* overlapping each other when being projected in the direction in which the first heat transfer plates 32 and the second heat transfer plates 34 are stacked are not formed. This enables the regions of the second pitch sections 40*b* not to be excessively weak.

According to Embodiment 1, identical sides of the second pitch sections 40*b* disposed in each of the first inner fins 33 are open in the direction in which the first heat transfer plates 32 and the second heat transfer plates 34 are stacked.

With this configuration, the first inner fins 33 each include the second pitch sections 40*b*, whose identical sides are open in the direction in which the first heat transfer plates 32 and the second heat transfer plates 34 are stacked. Thus, the regions of the second pitch sections 40*b*, which are always weaker and are capable of being fractured, are disposed in the plate heat exchanger 30 such that the identical sides are open in the direction in which the first inner fins 33 are stacked. Accordingly, it is easy to control ease of fracturing the first heat transfer plates 32 at the positions of the second pitch sections 40*b*. In addition, it is easy to manufacture the first inner fins 33.

According to Embodiment 1, the value calculated by dividing the width of each of the first pitch sections 40*a* by the width of each of the second pitch sections 40*b* is less than 1.

With this configuration, it is easy to control ease of fracturing the first heat transfer plates 32 at the positions of the second pitch sections 40*b*.

According to Embodiment 1, the value calculated by dividing the width of each of the first pitch sections 40*a* by the width of each of the second pitch sections 40*b* is more than 0.5.

With this configuration, the second pitch section 40*b* has a certain degree of strength without being excessively weak, and it is easy to control ease of fracturing the first heat transfer plates 32 at the positions of the second pitch sections 40*b*.

According to Embodiment 1, the recess-and-projection pitch section 40 of each of the first inner fins 33 extends, to be bent at right angles, orthogonally or parallel to the direction crossing the direction in which a heat medium flows through the heat medium passage 38 in each of the first inner fins 33.

With this configuration, it is easy to form and manufacture the first inner fins 33.

According to Embodiment 1, the orthogonal portion 41 of the recess-and-projection pitch section 40 of each of the first inner fins 33, which extends to connect a pair of the first heat transfer plates 32 in the pair of the first heat transfer plates 32, is disposed between and shifted from the orthogonal portions 41 adjacent to each other of the adjacent recess-and-projection pitch section 40 in the direction in which a heat medium flows through the heat medium passage 38 in each of the first inner fins 33.

With this configuration, two orthogonal portions 41 are not continuously adjacent to each other in the direction in which a heat medium flows through the heat medium passage 38 in each of the first inner fins 33. In addition, the heat medium whose heat exchange rate is low and that has flowed between the adjacent orthogonal portions 41 located immediately upstream of each orthogonal portion 41 can be subjected to heat exchange through the orthogonal portion 41, resulting in an increase in heat exchange efficiency.

According to Embodiment 1, the orthogonal portion 41 of the recess-and-projection pitch section 40 of each of the first inner fins 33, which extends to connect a pair of the first heat transfer plates 32 in the pair of the first heat transfer plates 32, is disposed at the center between and shifted from the orthogonal portions 41 adjacent to each other of the adjacent recess-and-projection pitch section 40 in the direction in which a heat medium flows through the heat medium passage 38 in each of the first inner fins 33.

With this configuration, two orthogonal portions 41 are not continuously adjacent to each other in the direction in which a heat medium flows through the heat medium passage 38 in each of the first inner fins 33. In addition, the heat medium whose heat exchange rate is lowest and that has flowed through the center between the adjacent orthogonal portions 41 located immediately upstream of each orthogonal portion 41 can be subjected to heat exchange through the orthogonal portion 41, resulting in a further increase in heat exchange efficiency.

According to Embodiment 1, the heat medium serving as the first fluid is water or brine.

With this configuration, for example, a frozen heat medium causes volume expansion or pressure increase, and the first heat transfer plate 32 may be fractured. Thus, the region of the second pitch section 40*b* is configured to be always weaker than the region of the first pitch section 40*a* and to be capable of being fractured. Accordingly, when the first heat transfer plate 32 is fractured at the position of the second pitch section 40*b*, a heat medium can be discharged into the space 60.

According to Embodiment 1, a second fluid that flows through the refrigerant passage 39 is refrigerant.

With this configuration, when the first heat transfer plate 32 is fractured at the position of the second pitch section 40*b*, a heat medium can be discharged into the space 60. Thus, even when the refrigerant is refrigerant such as a flammable refrigerant and the first heat transfer plate 32 is fractured at the position of the second pitch section 40*b*, it is possible to improve safety by completely preventing the refrigerant such as a flammable refrigerant from flowing into the building 21 through the heat medium circuit 20 without a heat medium and the refrigerant mixed.

According to Embodiment 1, the recess-and-projection pitch section 50 of each of the second inner fins 35 includes a recess and a projection smaller than a recess and a projection of the recess-and-projection pitch section 40 of each of the first inner fins 33.

With this configuration, the recess-and-projection pitch section 40 and the recess-and-projection pitch section 50 can be optimally formed according to respective properties of a heat medium and refrigerant, such as viscosity.

According to Embodiment 1, the heat transfer apparatus 100 includes the plate heat exchanger 30.

With this configuration, since the heat transfer apparatus 100 includes the plate heat exchanger 30, regardless of error factors such as manufacturing conditions or environmental conditions, a region to be fractured is always a region where the first heat transfer plate 32 and the second heat transfer plate 34 are not in contact with each other.

Embodiment 2

Figure 8:
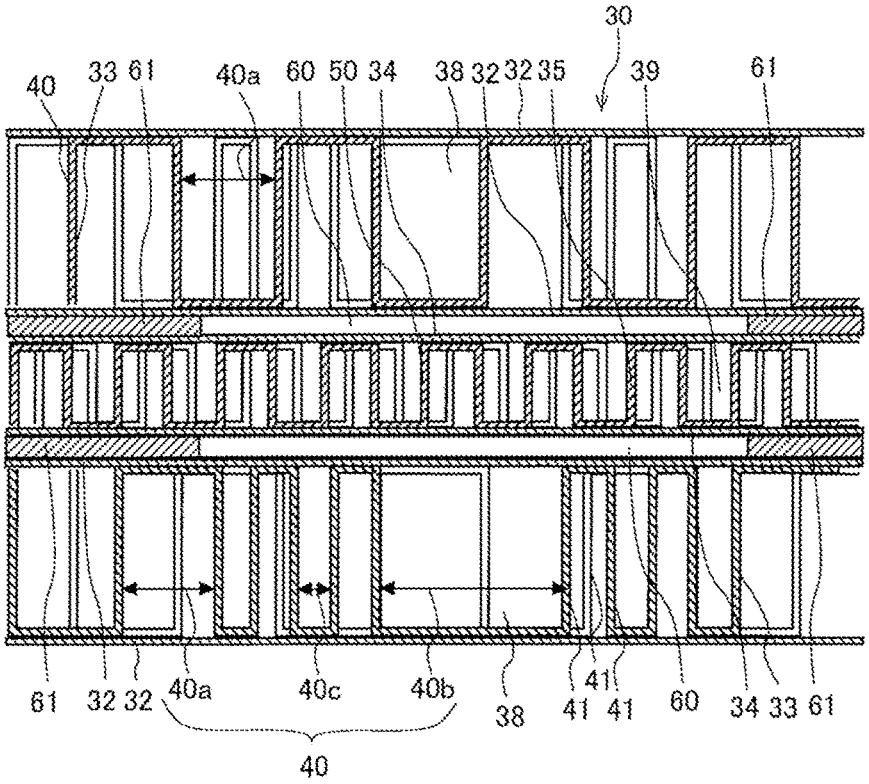
FIG. 8 is a diagram illustrating a plate heat exchanger according to Embodiment 2 in cross section.

FIG. 8 is a diagram illustrating a plate heat exchanger 30 according to Embodiment 2 in cross section. In Embodiment 2, points similar to those in Embodiment 1 described above are not described, and only the features are described.

As illustrated in FIG. 8, the recess-and-projection pitch section 40 of each of the first inner fins 33 includes, between the first pitch section 40*a* and the second pitch section 40*b*, third pitch sections 40*c*, whose width is narrower than that of the first pitch section 40*a*. Four third pitch sections 40*c* are disposed on each of the both sides of the second pitch section 40*b*.

Effects of Embodiment 2

According to Embodiment 2, the recess-and-projection pitch section 40 of each of the first inner fins 33 includes, between each of the first pitch sections 40*a* and a corresponding one of the second pitch sections 40*b*, the third pitch sections 40*c*, whose width is narrower than the width of each of the first pitch sections 40*a*.

With this configuration, the third pitch sections 40*c*, which are strong and each have a narrow width, are disposed on the both sides of the second pitch section 40*b*. This enables the both sides of the second pitch section 40*b* to be reinforced and thus enables the both sides of the second pitch section 40*b* not to be excessively weak.

Embodiment 3

Figure 9:
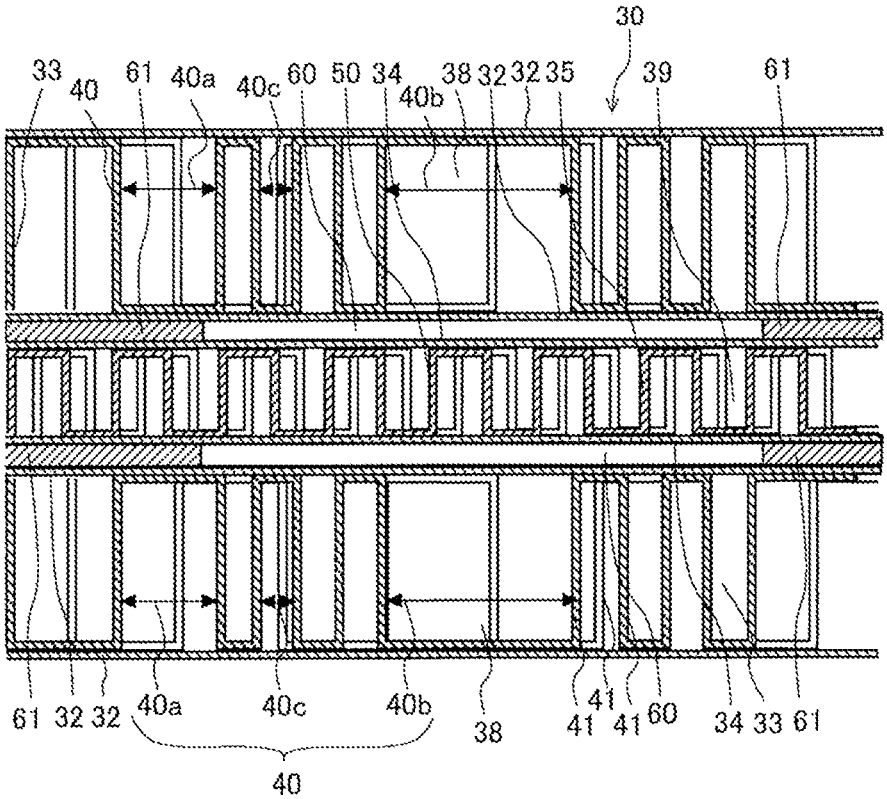
FIG. 9 is a diagram illustrating a plate heat exchanger according to Embodiment 3 in cross section.

FIG. 9 is a diagram illustrating a plate heat exchanger 30 according to Embodiment 3 in cross section. In Embodiment 3, points similar to those in Embodiment 1 and Embodiment 2 described above are not described, and only the features are described.

As illustrated in FIG. 9, the second pitch section 40*b* faces the second pitch section 40*b* of the first inner fin 33 between a pair of the first heat transfer plates 32 next to the adjacent pair of the second heat transfer plates 34 in the direction in which the first heat transfer plates 32 and the second heat transfer plates 34 are stacked. Respective openings of the second pitch sections 40*b* face each other.

The recess-and-projection pitch section 40 is disposed such that the recess-and-projection pitch section 40 and another recess-and-projection pitch section 40 of the first inner fin 33 in a pair of the first heat transfer plates 32 on the opposite side, from the recess-and-projection pitch section 40, of the adjacent pair of the second heat transfer plates 34 in the direction in which the first heat transfer plates 32 and the second heat transfer plates 34 are stacked are symmetrical.

Effects of Embodiment 3

According to Embodiment 3, each of the second pitch sections 40*b* faces a corresponding one of the second pitch sections 40*b* of one of the first inner fins 33 between a pair of the first heat transfer plates 32 next to the adjacent pair of the second heat transfer plates 34 in the direction in which the first heat transfer plates 32 and the second heat transfer plates 34 are stacked.

With this configuration, the second pitch section 40*b* faces the adjacent second pitch section 40*b* with a pair of the second heat transfer plates 34 interposed therebetween. This enables a reduction in the number of components interposed between the second pitch section 40*b* and the adjacent second pitch section 40*b* in the direction in which the first heat transfer plates 32 and the second heat transfer plates 34 are stacked. Thus, the region of the second pitch section 40*b* can be configured to be always weaker than that of the first pitch section 40*a* and to be capable of being fractured.

According to Embodiment 3, the recess-and-projection pitch section 40 is disposed such that the recess-and-projection pitch section 40 and another recess-and-projection pitch section 40 of one of the first inner fins 33 in a pair of the first heat transfer plates 32 on the opposite side, from the recess-and-projection pitch section 40, of the adjacent pair of the second heat transfer plates 34 in the direction in which the first heat transfer plates 32 and the second heat transfer plates 34 are stacked are symmetrical.

With this configuration, the second pitch section 40*b* always faces the adjacent second pitch section 40*b* with a pair of the second heat transfer plates 34 interposed therebetween. This enables a reduction in the number of components interposed between the second pitch section 40*b* and the adjacent second pitch section 40*b* in the direction in which the first heat transfer plates 32 and the second heat transfer plates 34 are stacked. Thus, the region of the second pitch section 40*b* can be configured to be always weaker than that of the first pitch section 40*a* and to be capable of being fractured.

REFERENCE SIGNS LIST

10: refrigerant circuit, 11: outdoor unit, 12: compressor, 13: four-way valve, 14: expansion valve, 15: outdoor heat exchanger, 16: refrigerant pipe, 20: heat medium circuit, 21: building, 22: circulating pump, 23: radiator, 24: heat medium pipe, 25: indoor unit, 30: plate heat exchanger, 31: side plate, 31*a*: heat medium inlet, 31*b*: heat medium outlet, 31*c*: refrigerant inlet, 31*d*: refrigerant outlet, 32: first heat transfer plate, 32*a*: heat medium outward hole, 32*b*: heat medium return hole, 32*c*: refrigerant outward hole, 32*d*: refrigerant return hole, 33: first inner fin, 34: second heat transfer plate, 34*a*: heat medium outward hole, 34*b*: heat medium return hole, 34*c*: refrigerant outward hole, 34*d*: refrigerant return hole, 35: second inner fin, 36: projecting portion, 37: projecting portion, 38: heat medium passage, 39: refrigerant passage, 40: recess-and-projection pitch section, 40*a*: first pitch section, 40*b*: second pitch section, 40*c*: third pitch section, 41: orthogonal portion, 50: recess-and-projection pitch section, 60: space, 61: soldering portion, 100: heat transfer apparatus

The invention claimed is:

1. A plate heat exchanger comprising:

a plurality of first heat transfer plates each having a flat heat transfer surface, a first passage being formed in each pair of the plurality of first heat transfer plates for a first fluid to flow;

a plurality of first inner fins each disposed in the corresponding first passage between a pair of the plurality of first heat transfer plates, the plurality of first inner fins being each formed by repeating a recess-and-projection pitch section;

a plurality of second heat transfer plates each having a flat heat transfer surface, a second passage being formed in each pair of the plurality of second heat transfer plates between corresponding two pairs of the plurality of first heat transfer plates for a second fluid, different than the first fluid, to flow; and a plurality of second inner fins each disposed in the corresponding second passage between a pair of the plurality of second heat transfer plates, the plurality of second inner fins being each formed by repeating a second recess-and-projection pitch section, wherein a space is formed between each of the plurality of first heat transfer plates and a corresponding one of the plurality of second heat transfer plates, the plate heat exchanger includes, in the space, a plurality of heat transfer components connecting each of the plurality of first heat transfer plates and a corresponding one of the plurality of second heat transfer plates, the plurality of heat transfer components being interspersed between each of the plurality of first heat transfer plates and a corresponding one of the plurality of second heat transfer plates, the recess-and-projection pitch section extending in a direction crossing a direction in which the first fluid flows through the first passage in each of the plurality of first inner fins includes first pitch sections and one or more of second pitch sections, a width of each of the second pitch sections being wider than a width of each of the first pitch sections, and the plurality of heat transfer components are disposed in regions of the first pitch sections when the plurality of heat transfer components are projected in a direction in which the plurality of first heat transfer plates and the plurality of second heat transfer plates are stacked.

2. The plate heat exchanger of claim 1, wherein the plurality of heat transfer components do not exist in regions of the one or more of the second pitch sections when the plurality of heat transfer components are projected in the direction in which the plurality of first heat transfer plates and the plurality of second heat transfer plates are stacked.

3. The plate heat exchanger of claim 1, wherein the one or more of the second pitch sections are disposed in the recess-and-projection pitch section with at least one of the first pitch sections interposed between the one or more of the second pitch sections in the direction crossing the direction in which the first fluid flows through the first passage in each of the plurality of first inner fins.

4. The plate heat exchanger of claim 1, wherein the one or more of the second pitch sections are disposed to be shifted, in the direction crossing the direction in which the first fluid flows through the first passage, from an other of the second pitch sections of the recess-and-projection pitch section different in position in the direction in which the first fluid flows through the first passage in each of the plurality of first inner fins.

5. The plate heat exchanger of claim 1, wherein the recess-and-projection pitch section including only the first pitch sections is disposed between the recess-and-projection pitch section including the one or more of the second pitch sections at a position in the direction in which the first fluid flows through the first passage in each of the plurality of first inner fins and the recess-and-projection pitch section including the one or more of the second pitch sections different in position in the direction in which the first fluid flows through the first passage in each of the plurality of first inner fins.

6. The plate heat exchanger of claim 5, wherein the recess-and-projection pitch section including the one or more of the second pitch sections at a position in the direction in which the first fluid flows through the first passage in each of the plurality of first inner fins faces the recess-and-projection pitch section including only the first pitch sections of one of the plurality of first inner fins between a pair of the plurality of first heat transfer plates next to an adjacent pair of the plurality of second heat transfer plates in the direction in which the plurality of first heat transfer plates and the plurality of second heat transfer plates are stacked.

7. The plate heat exchanger of claim 1, wherein the recess-and-projection pitch section of each of the plurality of first inner fins includes, between each of the first pitch sections and a corresponding one of the second pitch sections, a third pitch section whose width is narrower than the width of each of the first pitch sections.

8. The plate heat exchanger of claim 1, wherein identical sides of the second pitch sections disposed in each of the plurality of first inner fins are open in the direction in which the plurality of first heat transfer plates and the plurality of second heat transfer plates are stacked.

9. The plate heat exchanger of claim 1, wherein a value calculated by dividing the width of each of the first pitch sections by the width of each of the second pitch sections is less than 1.

10. The plate heat exchanger of claim 9, wherein the value calculated by dividing the width of each of the first pitch sections by the width of each of the second pitch sections is more than 0.5.

11. The plate heat exchanger of claim 1, wherein each of the second pitch sections faces a corresponding one of the second pitch sections of one of the plurality of first inner fins between a pair of the plurality of first heat transfer plates next to an adjacent pair of the plurality of second heat transfer plates in the direction in which the plurality of first heat transfer plates and the plurality of second heat transfer plates are stacked.

12. The plate heat exchanger of claim 11, wherein the recess-and-projection pitch section is disposed such that the recess-and-projection pitch section and an other recess-and-projection pitch section of one of the plurality of first inner fins in a pair of the plurality of first heat transfer plates on an opposite side, from the recess-and-projection pitch section, of an adjacent pair of the plurality of second heat transfer plates in the direction in which the plurality of first heat transfer plates and the plurality of second heat transfer plates are stacked are symmetrical.

13. The plate heat exchanger of claim 1, wherein the recess-and-projection pitch section of each of the plurality of first inner fins extends, to be bent at right angles, orthogonally or parallel to the direction crossing the direction in which the first fluid flows through the first passage in each of the plurality of first inner fins.

14. The plate heat exchanger of claim 1, wherein an orthogonal portion of the recess-and-projection pitch section of each of the plurality of first inner fins, the orthogonal portion extending to connect a pair of the plurality of first heat transfer plates in the pair of the plurality of first heat transfer plates, is disposed between and shifted from orthogonal portions adjacent to each other of an adjacent recess-and-projection pitch section in the direction in which the first fluid flows through the first passage in each of the plurality of first inner fins.

15. The plate heat exchanger of claim 14, wherein the orthogonal portion of the recess-and-projection pitch section of each of the plurality of first inner fins, the orthogonal portion extending to connect the pair of the plurality of first heat transfer plates in the pair of the plurality of first heat transfer plates, is disposed at a center between and shifted from the orthogonal portions adjacent to each other of the adjacent recess-and-projection pitch section in the direction in which the first fluid flows through the first passage in each of the plurality of first inner fins.

16. The plate heat exchanger of claim 1, wherein the first fluid is water or brine.

17. The plate heat exchanger of claim 1, wherein the second fluid that flows through the second passage is refrigerant.

18. The plate heat exchanger of claim 1, wherein the second recess-and-projection pitch section of each of the plurality of second inner fins includes a recess and a projection smaller than a recess and a projection of the recess-and-projection pitch section of each of the plurality of first inner fins.

19. A heat transfer apparatus comprising the plate heat exchanger of claim 1.

* * * * *